US006781486B2

(12) United States Patent
Killen et al.

(10) Patent No.: US 6,781,486 B2
(45) Date of Patent: Aug. 24, 2004

(54) HIGH EFFICIENCY STEPPED IMPEDANCE FILTER

(75) Inventors: William D. Killen, Melbourne, FL (US); Randy T. Pike, Grant, FL (US)

(73) Assignee: Harris Corporation, Melbourne, FL (US)

( * ) Notice: Subject to any disclaimer, the term of this patent is extended or adjusted under 35 U.S.C. 154(b) by 133 days.

(21) Appl. No.: 10/184,854

(22) Filed: Jun. 27, 2002

(65) Prior Publication Data

US 2004/0000971 A1 Jan. 1, 2004

(51) Int. Cl.[7] ..... H01P 1/20; H01P 3/08

(52) U.S. Cl. ..... 333/204; 343/911 R

(58) Field of Search ..... 333/204, 205, 333/133, 234, 186; 455/307; 310/364; 257/275; 343/700 MS, 909, 910, 911 R

(56) References Cited

U.S. PATENT DOCUMENTS

| | | | | |
|---|---|---|---|---|
| 3,571,722 A | | 3/1971 | Vendelin | |
| 3,678,418 A | | 7/1972 | Woodward | |
| 3,681,716 A | | 8/1972 | Chiron et al. | |
| 4,495,505 A | | 1/1985 | Shields | |
| 4,525,720 A | | 6/1985 | Corzine et al. | |
| 4,661,790 A | * | 4/1987 | Gannon et al. | 333/234 |
| 4,667,172 A | * | 5/1987 | Longshore et al. | 333/134 |
| 4,800,344 A | | 1/1989 | Graham | |
| 4,825,220 A | | 4/1989 | Edward et al. | |
| 4,882,553 A | | 11/1989 | Davies et al. | |
| 4,916,410 A | | 4/1990 | Littlefield | |
| 4,924,236 A | | 5/1990 | Schuss et al. | |
| 5,039,891 A | | 8/1991 | Wen et al. | |
| 5,148,130 A | | 9/1992 | Dietrich | |
| 5,343,176 A | * | 8/1994 | Hasler | 333/204 |
| 5,379,006 A | | 1/1995 | McCorkle | |
| 5,455,545 A | | 10/1995 | Garcia | |
| 5,523,728 A | | 6/1996 | McCorkle | |
| 5,678,219 A | | 10/1997 | Agarwal et al. | |

(List continued on next page.)

FOREIGN PATENT DOCUMENTS

| | | | |
|---|---|---|---|
| EP | 0 986 127 A2 | | 3/2000 |
| JP | 07 015218 | | 1/1995 |
| JP | 07 283619 | | 10/1995 |
| JP | 08 154006 | | 6/1996 |
| WO | WO 00/26149 | * | 5/2000 |
| WO | WO 01/01453 A2 | | 1/2001 |

OTHER PUBLICATIONS

Salahun, E., et al., "Ferromagnetic Composite–Based and Magnetically–tunable Microwave Devices", 2002 IEEE MTT–S International Microwave Sypmosium Digest, Jun. 2–7, 2002.

(List continued on next page.)

*Primary Examiner*—Patrick Wamsley
(74) *Attorney, Agent, or Firm*—Sacco & Associates, PA

(57) ABSTRACT

An RF filter that includes a substrate having a plurality of regions, each having respective substrate properties including a relative permeability and a relative permittivity. At least one filter section is coupled to one of the regions of the substrate which has different substrate properties in comparison to other regions. Other filter sections can be coupled to other substrate regions having different substrate properties. The permeability and/or permittivity can be controlled by the addition of meta-materials to the substrate and/or by the creation of voids in the substrate. The RF filter can be a stepped impedance filter. One filter section includes a transmission line section having an impedance influenced by the region of the substrate on which the filter section is disposed. The transmission line section construction can be a microstrip, buried microstrip, or stripline. A supplemental layer of the substrate can be disposed beneath the filter section.

14 Claims, 4 Drawing Sheets

U.S. PATENT DOCUMENTS

| | | | | |
|---|---|---|---|---|
| 6,052,039 | A | 4/2000 | Chiou et al. | |
| 6,114,940 | A | 9/2000 | Kakinuma et al. | |
| 6,133,806 | A | 10/2000 | Sheen | |
| 6,137,376 | A | 10/2000 | Imbornone et al. | |
| 6,184,845 | B1 | 2/2001 | Leisten et al. | |
| 6,307,509 | B1 | 10/2001 | Krantz | |
| 6,661,392 | B2 * | 12/2003 | Isaacs et al. | 343/911 R |
| 6,711,394 | B2 * | 3/2004 | Abdelmonem | 455/307 |
| 6,714,099 | B2 * | 3/2004 | Hikita et al. | 333/133 |

OTHER PUBLICATIONS

U.S. patent application Ser. No. 10/448,973, Delgado et al., filed May 30, 2003.
U.S. patent application Ser. No. 10/184,277, Killen et al., filed Jun. 27, 2002.
U.S. patent application Ser. No. 10/185,443, Killen et al., filed Jun. 27, 2002.
U.S. patent application Ser. No. 10/184,332, Killen et al., filed Jun. 27, 2002.
U.S. patent application Ser. No. 10/185,251, Parsche et al., filed Jun. 27, 2002.
U.S. patent application Ser. No. 10/185,847, Killen et al., filed Jun. 27, 2002.
U.S. patent application Ser. No. 10/185,275, Killen et al., filed Jun. 27, 2002.
U.S. patent application Ser. No. 10/185,273, Killen et al., filed Jun. 27, 2002.
U.S. patent application Ser. No. 10/308,500, Killen et al., filed Dec. 3, 2002.
U.S. patent application Ser. No. 10/373,935, Killen et al., filed Feb. 25, 2003.
U.S. patent application Ser. No. 10/404,285, Killen et al., filed Mar. 31, 2003.
U.S. patent application Ser. No. 10/404,981, Killen et al., filed Mar. 31, 2003.
U.S. patent application Ser. No. 10/404,960, Killen et al., filed Mar. 31, 2003.
U.S. patent application Ser. No. 10/185,144, Killen et al., filed Jun. 27, 2002.
U.S. patent application Ser. No. 10/185,266, Killen et al., filed Jun. 27, 2002.
U.S. patent application Ser. No. 10/185,162, Rumpf, Jr. et al., filed Jun. 27, 2002.
U.S. patent application Ser. No. 10/185,824, Killen et al., filed Jun. 27, 2002.
U.S. patent application Ser. No. 10/185,187, Killen et al., filed Jun. 27, 2002.
U.S. patent application Ser. No. 10/185,855, Killen et al., filed Jun. 27, 2002.
U.S. patent application Ser. No. 10/185,459, Killen et al., filed Jun. 27, 2002.
U.S. patent application Ser. No. 10/185,480, Killen et al., filed Jun. 27, 2002.
U.S. patent application Ser. No. 10/439,094, Delgado et al., filed May 25, 2003.
U.S. patent application Ser. No. 10/185,570, Killen et al., filed Jun. 27, 2002.
U.S. patent application Ser. No. 10/185,215, Killen et al., filed Jun. 27, 2002.
U.S. patent application Ser. No. 10/614,626, Zarro et al., filed Jul. 7, 2003.

* cited by examiner

HIGH EFFICIENCY STEPPED IMPEDANCE FILTER

BACKGROUND OF THE INVENTION

1. Statement of the Technical Field

The inventive arrangements relate generally to methods and apparatus for providing increased design flexibility for RF circuits, and more particularly for optimization of dielectric circuit board materials for improved performance in RF filters.

2. Description of the Related Art

Microstrip and stripline radio frequency (RF) filters are commonly manufactured on specially designed substrate boards. One type of RF filter is a stepped impedance filter. A stepped impedance filter utilizes alternating high impedance and low impedance transmission line sections rather than primarily reactive components, such as inductors and capacitors, or resonant line stubs. Hence, stepped impedance filters are relatively easy to design and are typically smaller than other types of filters. Accordingly, stepped impedance filters are advantageous in circuits where a small filter is required.

Stepped impedance filters used in RF circuits are typically formed in one of three ways. One configuration known as microstrip, places a stepped impedance filter on a board surface and provides a second conductive layer, commonly referred to as a ground plane. A second type of configuration known as buried microstrip is similar except that the stepped impedance filter is covered with a dielectric substrate material. In a third configuration known as stripline, the stepped impedance filter is sandwiched within substrate between two electrically conductive (ground) planes.

Two critical factors affecting the performance of a substrate material are permittivity (sometimes called the relative permittivity or $\epsilon_r$) and the loss tangent (sometimes referred to as the dissipation factor). The relative permittivity determines the speed of the signal, and therefore the electrical length of transmission lines and other components implemented on the substrate. The loss tangent characterizes the amount of loss that occurs for signals traversing the substrate material. Accordingly, low loss materials become even more important with increasing frequency, particularly when designing receiver front ends and low noise amplifier circuits.

Ignoring loss, the characteristic impedance of a transmission line, such as stripline or microstrip, is equal to $\sqrt{L_l/C_l}$ where $L_l$ is the inductance per unit length and $C_l$ is the capacitance per unit length. The values of $L_l$ and $C_l$ are generally determined by the physical geometry and spacing of the line structure as well as the permittivity of the dielectric material(s) used to separate the transmission line structures.

In conventional RF design, a substrate material is selected that has a relative permittivity value suitable for the design. Once the substrate material is selected, the line characteristic impedance value is exclusively adjusted by controlling the line geometry and physical structure.

The permittivity of the chosen substrate material for a transmission line, passive RF device, or radiating element influences the physical wavelength of RF energy at a given frequency for that line structure. One problem encountered when designing microelectronic RF circuitry is the selection of a dielectric board substrate material that is optimized for all of the various passive components, radiating elements and transmission line circuits to be formed on the board. In particular, the geometry of certain circuit elements may be physically large or miniaturized due to the unique electrical or impedance characteristics required for such elements. Similarly, the line widths required for exceptionally high or low characteristic impedance values can, in many instances, be too narrow or too wide respectively for practical implementation for a given substrate material. Since the physical size of the microstrip or stripline is inversely related to the relative permittivity of the dielectric material, the dimensions of a transmission line can be affected greatly by the choice of substrate board material.

An inherent problem with the foregoing approach is that, at least with respect to the substrate material, the only control variable for line impedance is the relative permittivity, $\epsilon_r$. This limitation highlights an important problem with conventional substrate materials, i.e. they fail to take advantage of the other factor that determines characteristic impedance, namely $L_l$, the inductance per unit length of the transmission line.

Conventional circuit board substrates are generally formed by processes such as casting or spray coating which generally result in uniform substrate physical properties, including the permittivity. Accordingly, conventional dielectric substrate arrangements for RF circuits have proven to be a limitation in designing circuits that are optimal in regards to both electrical and physical size characteristics.

SUMMARY OF THE INVENTION

The present invention relates to an RF filter. The RF filter includes a substrate having a plurality of regions. Each of the regions has respective substrate properties including a relative permeability and a relative permittivity. At least one filter section is coupled to one of the regions of the substrate which has substrate properties different as compared to at least one other region of the substrate. Other filter sections can be coupled to other substrate regions having different substrate properties as well. For example, the permeability and/or the permittivity of the substrate regions can be different. At least one of the permeability and the permittivity can be controlled by the addition of meta-materials to the substrate and/or by the creation of voids in the substrate.

The RF filter can be a stepped impedance filter. At least one filter section includes a transmission line section having an impedance influenced by the region of the substrate on which the filter section is disposed. The transmission line section construction can be selected from the group consisting of microstrip, buried microstrip, and stripline. Further, the RF filter can include a supplemental layer of the substrate disposed beneath the filter section.

DETAILED DESCRIPTION OF THE PREFERRED EMBODIMENTS

A stepped impedance filter is commonly used in radio frequency (RF) circuits and usually implemented on printed circuit boards or substrates. Stepped impedance filters typically have an input port, an output port, and multiple alternating high impedance and low impedance transmission line sections. The length and width of each transmission line section, as well as the substrate characteristics of the circuit board where the transmission line section is coupled, can be adjusted to attain a desired impedance.

Low permittivity printed circuit board materials are ordinarily selected for RF circuit designs implementing stepped impedance filters. For example, polytetrafluoroethylene (PTFE) based composites such as RT/duroid® 6002 (permittivity of 2.94; loss tangent of 0.009) and RT/duroid® 5880 (permittivity of 2.2; loss tangent of 0.0007) are both available from Rogers Microwave Products, Advanced Circuit Materials Division, 100 S. Roosevelt Ave, Chandler, Ariz. 85226. Both of these materials are common board material choices. The above board materials provide substrate layers having relatively low permittivities with accompanying low loss tangents.

However, use of conventional board materials can compromise the miniaturization of circuit elements and may also compromise some performance aspects of circuits that can benefit from high permittivity layers. A typical tradeoff in a communications circuit is between the physical size of a stepped impedance filter versus operational frequency. By comparison, the present invention provides the circuit designer with an added level of flexibility by permitting use of a high permittivity substrate layer region with magnetic properties optimized for reducing the size of a stepped impedance filter for operation at a specific frequency. Further, the present invention also provides the circuit designer with means for controlling the quality factor (Q) of the stepped impedance filter. This added flexibility enables improved performance and stepped impedance filter density and performance not otherwise possible for RF circuits. As defined herein, RF means any frequency that can be used to propagate an electromagnetic wave.

Figure 1:
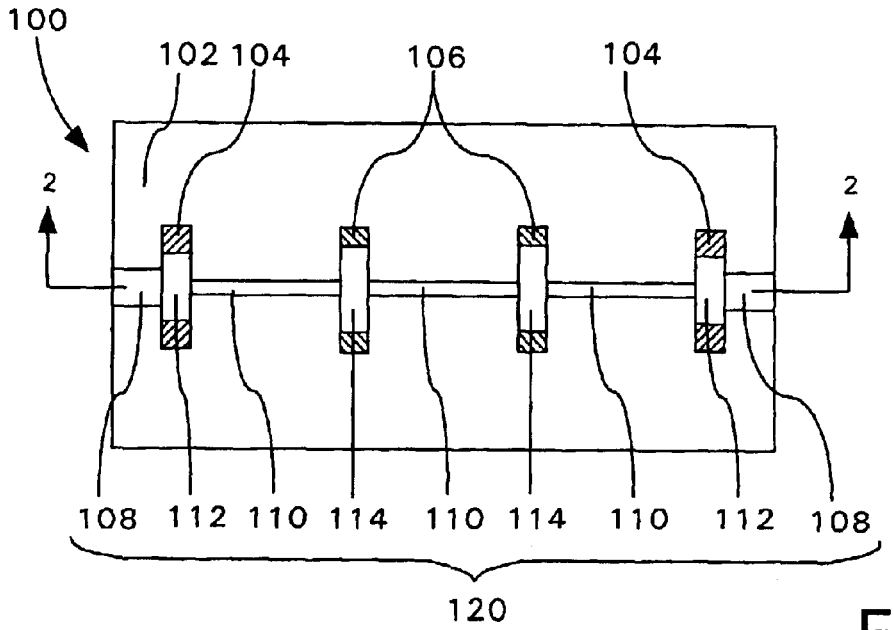
FIG. 1 is a top view of a stepped impedance filter formed on a substrate for reducing the size of the stepped impedance filter in accordance with the present invention.

FIG. 1 shows an exemplary stepped impedance filter 120 mounted to substrate layer 100. The embodiment illustrated in FIG. 1 is a seven-element low-pass filter design for explanation purposes, however, it should be noted that the present invention is not limited with regard to the number of elements or specific filter characteristics. The present invention can be used for any type of stepped impedance filter having any number of elements, for example high pass filters, band pass filters, band notch filters, saw-tooth filters, comb filters, etc.

The substrate layer 100 comprises a first region 102 having a first set of substrate properties. One or more additional regions are included in the substrate layer to provide specific substrate properties proximate to transmission line sections. For example, second regions 104, each having a second set of substrate properties, can be provided. Third regions 106 having a third set of substrate properties also can be provided. Additional regions, each having associated substrate properties, can be provided as well.

The substrate properties can include a generalized, complex valued permittivity and permeability other than 1+0j. Notably, the first, second and third sets of substrate properties all can differ from each other. For example, the second regions 104 can have a higher permittivity and/or permeability than the first region 102. The third regions 106 can have an even higher permittivity and/or permeability.

The exemplary stepped impedance filter 120 comprises multiple transmission line sections 110, 112 and 114 and input/output ports 108. High impedance transmission line sections 110 are coupled to the first region 102 and lower impedance transmission line sections 112 are coupled to the second regions 104. Finally, lowest impedance transmission line sections 114 are coupled to third regions 106, as shown. In this manner the substrate properties proximate to each transmission line section can be optimized for the impedance requirements of each section.

Figure 2:
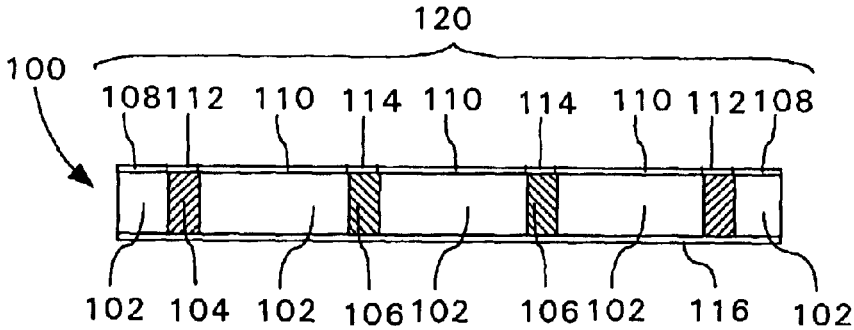
FIG. 2 is a cross-sectional view of the stepped impedance filter of FIG. 1 taken along line 2—2.

FIG. 2 is a sectional view, shown along section line 2—2, of the stepped impedance filter 120 and substrate layer 100 of FIG. 1. A ground plane 116 can be provided beneath the stepped impedance filter. Accordingly, substrate layer 100 has a thickness that defines a stepped impedance filter 120 height above ground. The thickness is approximately equal to the physical distance from the stepped impedance filter 120 to the underlying ground plane 116. This distance can be adjusted to achieve particular dielectric geometries, for example, to increase or decrease capacitance when a certain dielectric material is used.

An increase in permittivity in a particular region also increases the capacitance of transmission line sections proximate to the region. Further, an increase in the permeability of a particular region increases the inductance of transmission line sections proximate to the region as well. In another embodiment (not shown), the stepped impedance filter can have its own individual ground plane 116 or return trace (such as in a twin line arrangement) configured so that current on the ground plane 116 or return trace flows in an opposite direction to current flowing in the transmission line sections 110–114. The opposite current flow will result in cancellation of magnetic flux associated with the transmission line sections 110–114 and lower the inductance of those sections.

Accordingly, permittivity and permeability in each region can be adjusted to attain desired capacitance and inductance values selected to achieve specific impedance characteristics for the correlating transmission line segments. For example, the capacitance and inductance can be adjusted to achieve a desired Q for the stepped impedance filter response, which can be selected to improve filter response.

In general, the propagation velocity of a signal traveling in a transmission line Approximately inversely proportional to $\sqrt{\mu\epsilon}$. Since propagation velocity is inversely proportion to relative permeability and relative permittivity, increasing the permeability and/or permittivity in the selected regions of the substrate layer 100 decreases propagation velocity of the signal on a transmission line segments coupled to the selected regions, and thus the signal wavelength. Hence, the length and width of the transmission line sections 110–114 can be reduced in size by increasing the permeability and/or permittivity of selected regions, for example second regions 104 and third regions 106. Accordingly, the stepped impedance filter 120 can be smaller, both in length and width, than would otherwise be required on a conventional circuit board.

The permittivity and/or permeability of the substrate layer 100 can be differentially modified at selected regions to optimize stepped impedance filter performance. In yet another arrangement, all substrate layer regions can be modified by differentially modifying permittivity and/or permeability in all regions of the substrate layer.

The term "differential modifying" as used herein refers to any modifications, including additions, to the substrate layer 100 that result in at least one of the dielectric and magnetic properties being different at one region of the substrate as compared to another region. For example, the modification can be a selective modification where certain substrate layer regions are modified to produce a specific dielectric or magnetic properties, while other substrate layer regions are left un-modified.

Figure 3:
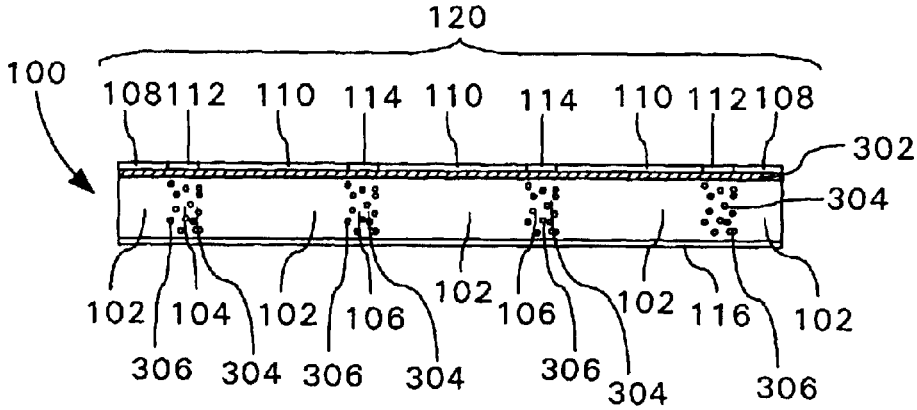
FIG. 3 is a cross-sectional view of an alternate embodiment of the stepped impedance filter of FIG. 1 taken along line 2—2.

According to one embodiment, a supplemental dielectric layer can be added to substrate layer 100. Techniques known in the art such as various spray technologies, spin-on technologies, various deposition technologies or sputtering can be used to apply the supplemental layer. Referring to FIG. 3, a first supplemental layer 302 can be added over the entire existing substrate layer 100 and/or a second supplemental layer 304 can be selectively added in the second and third regions 104 and 106, or selected portions thereof. The supplemental layers 302 and 304 can be applied to result in a change of permittivity and/or permeability for the dielectric beneath stepped impedance filter 120. In an alternate embodiment, the supplemental layer can be added to the first region 102 or selected portions thereof. For example, the supplemental layer can be added below the high impedance transmission line section and/or input/output ports 108 to increase the permittivity and/or permeability in those regions.

Notably, the second supplemental layer 304 can include particles 306 to change the relative permeability in the first, second and/or third regions 102–106 to be than 1. For example, diamagnetic or ferromagnetic particles can be added to any of the regions 102–106. Further, dielectric particles can be added to any of the regions 102–106 as well. Additionally, the first supplemental layer 302 and the second supplemental layer 304 can be provided in any circuit configuration, for example stripline, microstrip and buried microstrip.

Figure 4:
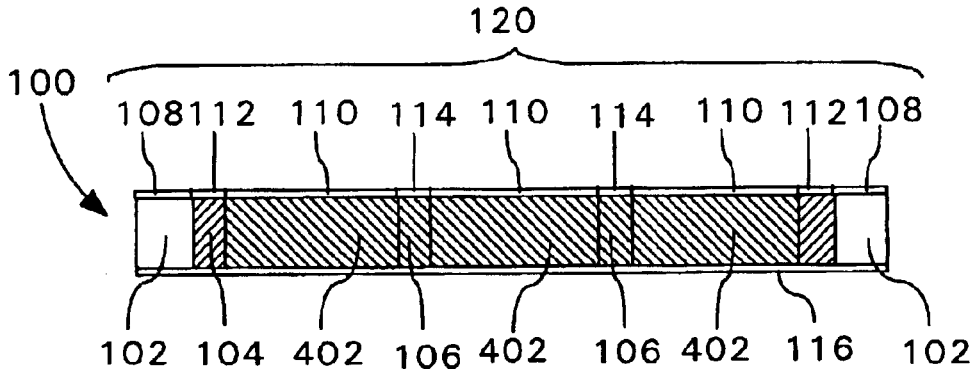
FIG. 4 is a cross-sectional view of an yet another embodiment of the stepped impedance filter of FIG. 1 taken along line 2—2.

An alternate embodiment of the present invention is shown in FIG. 4. Fourth substrate regions 402 can be provided proximate to the high impedance transmission line sections 110. As with the other regions of the substrate layer 100, the permttivity and permeability in the fourth substrate regions 402 can be adjusted to achieve particular electrical characteristics for the high impedance transmission line sections 110. For example, the permittivity and permeability of the fourth substrate regions can be adjusted to achieve a desired inductance, capacitance, impedance and/or Q for the high impedance transmission line sections 110.

Figure 5:
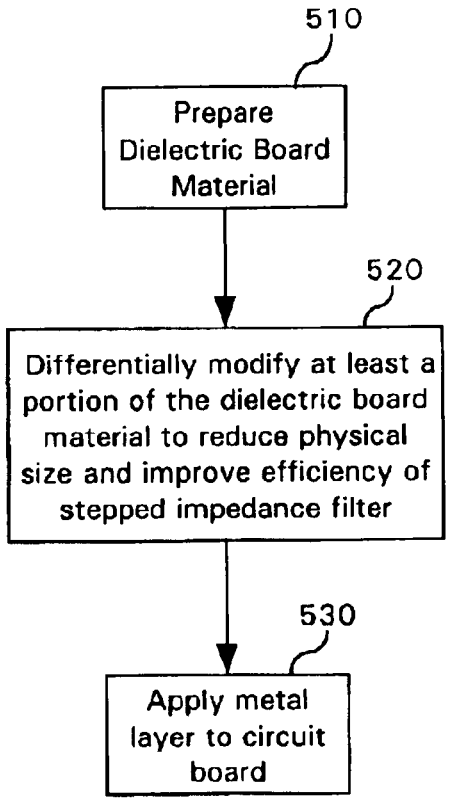
FIG. 5 is a flow chart that is useful for illustrating a process for manufacturing a stepped impedance filter of reduced physical size in accordance with the present invention.

A method for providing a size and performance optimized stepped impedance filter is described with reference to the text below and the flow chart presented in FIG. 5. In step 510, board dielectric material is prepared for modification. As previously noted, the board material can include commercially available off the shelf board material or customized board material formed from a polymer material, or some combination thereof. The preparation process can be made dependent upon the type of board material selected.

In step 520, one or more substrate layer regions, such as the first, second and third regions 102–106, can be differentially modified so that the permittivity and/or permeability differ between two or more portions of the regions. The differential modification can be accomplished in several different ways, as previously described. Referring to step 530, the metal layer then can be applied to form the stepped impedance filter 120 using standard circuit board techniques known in the art.

Figure 6A:
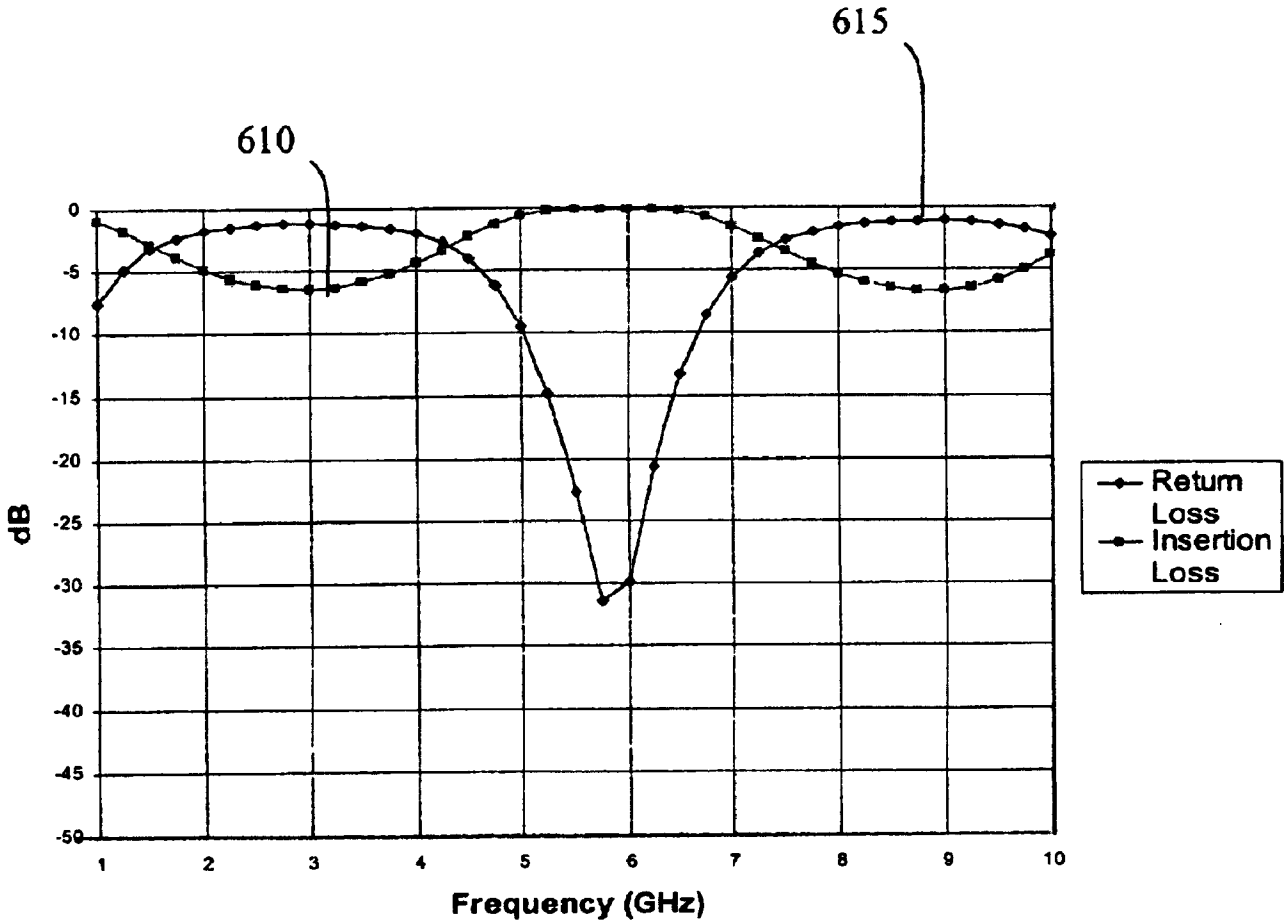
FIG. 6A is a graph including an insertion loss curve and a return loss curve for a typical low pass stepped impedance filter.
Figure 6B:
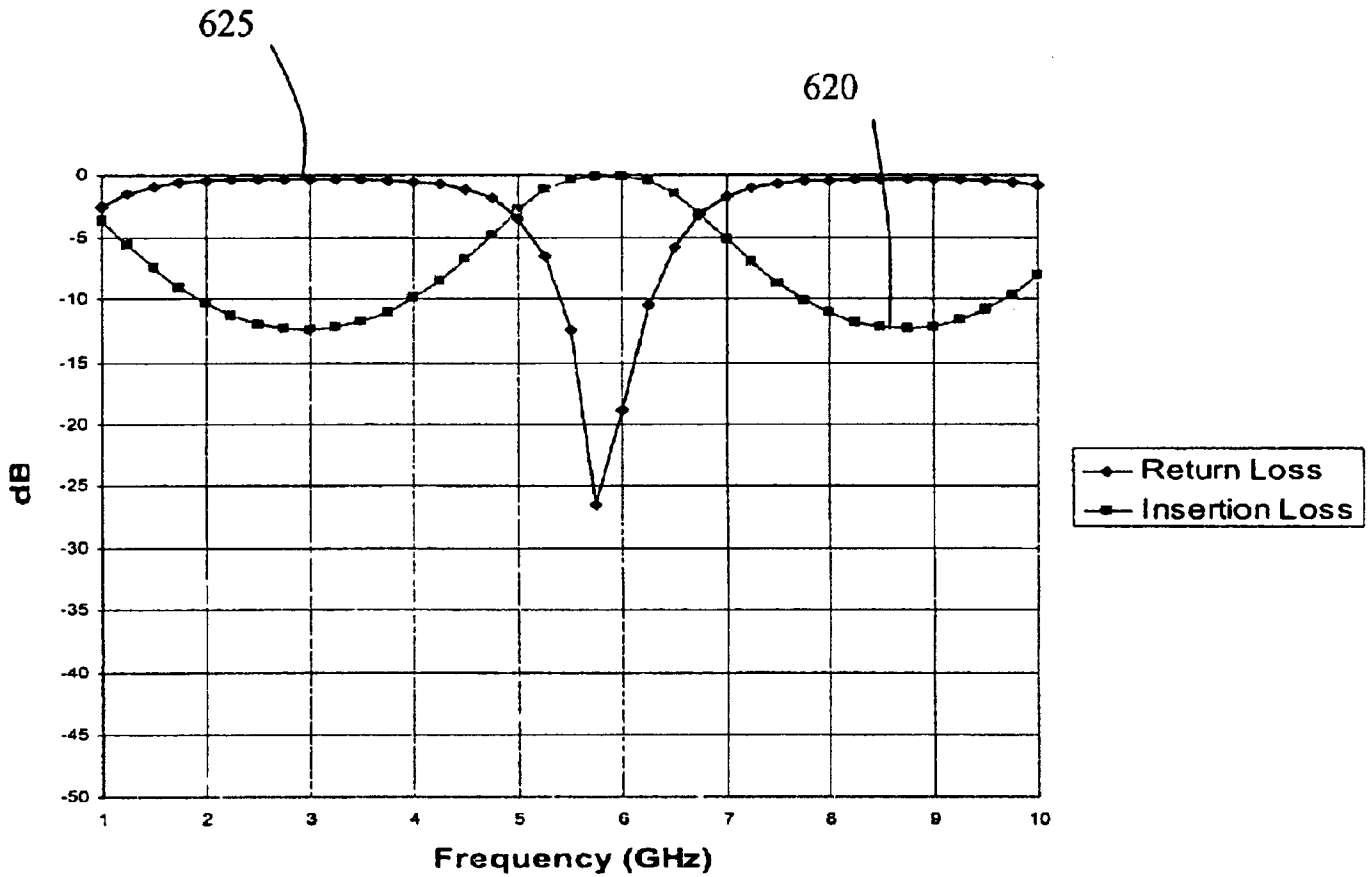
FIG. 6B is a graph including an insertion loss curve and a return loss curve achieved using substrate regions having different substrate properties in accordance with the present invention.

Referring to FIG. 6A, an insertion loss curve 610 and a return loss curve 615 curve is provided for a typical low pass stepped impedance filter. FIG. 6B shows an insertion loss curve 620 and a return loss curve 625 achieved using substrate regions having different properties in accordance with the present invention. As can be seen by comparing the graphs, a significant improvement in filter performance is achieved using a substrate having regions with differing substrate properties.

Dielectric substrate boards having meta-material regions providing localized and selectable magnetic and substrate properties can be prepared in the following manner. As defined herein, the term "meta-materials" refers to composite materials formed from the mixing or arrangement of two or more different materials at a very fine level, such as the molecular or nanometer level. Meta-materials allow tailoring of electromagnetic properties of the composite, which can be defined by effective electromagnetic parameters comprising effective electrical permittivity $\in\epsilon_{eff}$ (or permittivity) and the effective magnetic permeability $\mu_{eff}$.

Appropriate bulk dielectric ceramic substrate materials can be obtained from commercial materials manufacturers, such as DuPont and Ferro. The unprocessed material, commonly called Green Tape™, can be cut into sized regions from a bulk dielectric tape, such as into 6 inch by 6 inch regions. For example, DuPont Microcircuit Materials provides Green Tape material systems, such as 951 Low-Temperature Cofire Dielectric Tape and Ferro Electronic Materials ULF28-30 Ultra Low Fire COG dielectric formulation. These substrate materials can be used to provide substrate layers having relatively moderate permittivities with accompanying relatively low loss tangents for circuit operation at microwave frequencies once fired.

In the process of creating a microwave circuit using multiple sheets of dielectric substrate material, features such as vias, voids, holes, or cavities can be punched through one or more layers of tape. Voids can be defined using mechanical means (e.g. punch) or directed energy means (e.g., laser drilling, photolithography), but voids can also be defined using any other suitable method. Some vias can reach through the entire thickness of the sized substrate, while some voids can reach only through varying regions of the substrate thickness.

The vias can then be filled with metal or other dielectric or magnetic materials, or mixtures thereof, usually using stencils for precise placement of the backfill materials. The individual layers of tape can be stacked together in a conventional process to produce a complete, multi-layer substrate. Alternatively, individual layers of tape can be stacked together to produce an incomplete, multi-layer substrate generally referred to as a sub-stack.

Voided regions can also remain voids. If backfilled with selected materials, the selected materials preferably include meta-materials. The choice of a meta-material composition can provide controllable effective dielectric constants over a relatively continuous range from less than 2 to at least 2650. Controllable magnetic properties are also available from certain meta-materials. For example, through choice of suitable materials the relative effective magnetic permeability generally can range from about 4 to 116 for most practical RF applications. However, the relative effective magnetic permeability can be as low as about 2 or reach into the thousands.

The term "differentially modified" as used herein refers to modifications, including dopants, to a dielectric substrate layer that result in at least one of the dielectric and magnetic properties being different at one region of the substrate as compared to another region. A differentially modified board substrate preferably includes one or more meta-material containing regions.

For example, the modification can be selective modification where certain substrate layer regions are modified to produce a first set of dielectric or magnetic properties, while other substrate layer regions are modified differentially or left unmodified to provide dielectric and/or magnetic properties different from the first set of properties. Differential modification can be accomplished in a variety of different ways.

According to one embodiment, a supplemental dielectric layer can be added to the substrate layer. Techniques known in the art such as various spray technologies, spin-on technologies, various deposition technologies or sputtering can be used to apply the supplemental dielectric layer. The supplemental dielectric layer can be selectively added in localized regions, including inside voids or holes, or over the entire existing substrate layer. For example, a supplemental dielectric layer can be used for providing a substrate region having an increased effective dielectric constant. The dielectric material added as a supplemental layer can include various polymeric materials.

The differential modifying step can further include locally adding additional material to the substrate layer or supplemental dielectric layer. The addition of material can be used to further control the effective dielectric constant or magnetic properties of the substrate layer to achieve a given design objective.

The additional material can include a plurality of metallic and/or ceramic particles. Metal particles preferably include iron, tungsten, cobalt, vanadium, manganese, certain rare-earth metals, nickel or niobium particles. The particles are preferably nanosize particles, generally having sub-micron physical dimensions, hereafter referred to as nanoparticles.

The particles, such as nanoparticles, can preferably be organofunctionalized composite particles. For example, organofunctionalized composite particles can include particles having metallic cores with electrically insulating coatings or electrically insulating cores with a metallic coating.

Magnetic meta-material particles that are generally suitable for controlling magnetic properties of substrate layer for a variety of applications described herein include ferrite organoceramics (FexCyHz)—(Ca/Sr/Ba-Ceramic). These particles work well for applications in the frequency range of 8–40 GHz. Alternatively, or in addition thereto, niobium organoceramics (NbCyHz)—(Ca/Sr/Ba-Ceramic) are useful for the frequency range of 12–40 GHz. The materials designated for high frequency are also applicable to low frequency applications. These and other types of composite particles can be obtained commercially.

In general, coated particles are preferable for use with the present invention as they can aid in binding with a polymer matrix or side chain moiety. In addition to controlling the magnetic properties of the dielectric, the added particles can also be used to control the effective dielectric constant of the material. Using a fill ratio of composite particles from approximately 1 to 70%, it is possible to raise and possibly lower the dielectric constant of substrate substrate layer and/or supplemental dielectric layer regions significantly. For example, adding organofunctionalized nanoparticles to a substrate layer can be used to raise the dielectric constant of the modified substrate layer regions.

Particles can be applied by a variety of techniques including polyblending, mixing and filling with agitation. For example, a dielectric constant may be raised from a value of 2 to as high as 10 by using a variety of particles with a fill ratio of up to about 70%. Metal oxides useful for this purpose can include aluminum oxide, calcium oxide, magnesium oxide, nickel oxide, zirconium oxide and niobium (II, IV and V) oxide. Lithium niobate ($LiNbO_3$), and zirconates, such as calcium zirconate and magnesium zirconate, also may be used.

The selectable substrate properties can be localized to areas as small as about 10 nanometers, or cover large area regions, including the entire board substrate surface. Conventional techniques such as lithography and etching along with deposition processing can be used for localized dielectric and magnetic property manipulation.

Materials can be prepared mixed with other materials or including varying densities of voided regions (which generally introduce air) to produce effective dielectric constants in a substantially continuous range from 2 to about 2650, as well as other potentially desired substrate properties. For example, materials exhibiting a low dielectric constant (<2 to about 4) include silica with varying densities of voided regions. Alumina with varying densities of voided regions can provide a dielectric constant of about 4 to 9. Neither silica nor alumina have any significant magnetic permeability. However, magnetic particles can be added, such as up to 20 wt. %, to render these or any other material significantly magnetic. For example, magnetic properties may be tailored with organofunctionality. The impact on dielectric constant from adding magnetic materials generally results in an increase in the dielectric constant.

Medium dielectric constant materials have a dielectric constant generally in the range of 70 to 500+/−10%. As noted above these materials may be mixed with other materials or voids to provide desired effective dielectric constant values. These materials can include ferrite doped calcium titanate. Doping metals can include magnesium, strontium and niobium. These materials have a range of 45 to 600 in relative magnetic permeability.

For high dielectric constant applications, ferrite or niobium doped calcium or barium titanate zirconates can be used. These materials have a dielectric constant of about 2200 to 2650. Doping percentages for these materials are generally from about 1 to 10%. As noted with respect to other materials, these materials may be mixed with other materials or voids to provide desired effective dielectric constant values.

These materials can generally be modified through various molecular modification processing. Modification processing can include void creation followed by filling with materials such as carbon and fluorine based organo functional materials, such as polytetrafluoroethylene PTFE.

Alternatively or in addition to organofunctional integration, processing can include solid freeform fabrication (SFF), photo, UV, x-ray, e-beam or ion-beam irradiation. Lithography can also be performed using photo, UV, x-ray, e-beam or ion-beam radiation.

Different materials, including meta-materials, can be applied to different areas on substrate layers (sub-stacks), so that a plurality of areas of the substrate layers (sub-stacks) have different dielectric and/or magnetic properties. The backfill materials, such as noted above, may be used in conjunction with one or more additional processing steps to attain desired, dielectric and/or magnetic properties, either locally or over a bulk substrate region.

A top layer conductor print is then generally applied to the modified substrate layer, sub-stack, or complete stack. Conductor traces can be provided using thin film techniques, thick film techniques, electroplating or any other suitable technique. The processes used to define the conductor pattern include, but are not limited to standard lithography and stencil.

A base plate is then generally obtained for collating and aligning a plurality of modified board substrates. Alignment holes through each of the plurality of substrate boards can be used for this purpose.

The plurality of layers of substrate, one or more sub-stacks, or combination of layers and sub-stacks can then be laminated (e.g. mechanically pressed) together using either isostatic pressure, which puts pressure on the material from all directions, or uniaxial pressure, which puts pressure on the material from only one direction. The laminate substrate is then is further processed as described above or placed into an oven to be fired to a temperature suitable for the processed substrate (approximately 850 C. to 900 C. for the materials cited above).

The plurality of ceramic tape layers and stacked sub-stacks of substrates can then be fired, using a suitable furnace that can be controlled to rise in temperature at a rate suitable for the substrate materials used. The process conditions used, such as the rate of increase in temperature, final temperature, cool down profile, and any necessary holds, are selected mindful of the substrate material and any material backfilled therein or deposited thereon. Following firing, stacked substrate boards, typically, are inspected for flaws using an optical microscope.

The stacked ceramic substrates can then be optionally diced into cingulated pieces as small as required to meet circuit functional requirements. Following final inspection, the cingulated substrate pieces can then be mounted to a test fixture for evaluation of their various characteristics, such as to assure that the dielectric, magnetic and/or electrical characteristics are within specified limits.

Thus, dielectric substrate materials can be provided with localized selected dielectric and/or magnetic characteristics for improving the density and performance of circuits, including those comprising stepped impedance filters. The dielectric flexibility allows independent optimization of circuit elements.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

What is claimed is:

1. An RF filter comprising:

a substrate comprising at least one substrate layer having a first dielectric substrate material in a first region and at least a second dielectric substrate material in a second region, said second dielectric substrate material having substrate properties different than said first dielectric substrate material;

a first filter section disposed on said substrate and coupled to said first region and at least a second filter section disposed on said substrate and coupled to said second region.

2. The RF filter according to claim 1 wherein at least one of said first and second filter sections is comprised of a transmission line section, said transmission line section having an impedance influenced by said region of said substrate to which said at least one filter section is coupled.

3. The RF filter according to claim 2 wherein said transmission line section is selected from the group consisting of microstrip, buried microstrip, and stripline.

4. The RF filter according to claim 2 wherein said filter is a stepped impedance filter.

5. The RF filter according to claim 1 wherein a permeability of said first region is different as compared to a permeability of said second region.

6. The RF filter according to claim 1 wherein a permittivity of said first region is different as compared to a permittivity of said second region.

7. The RF filter according to claim 1 wherein a permeability and a permittivity of said first region is different as compared to a permeability and a permittivity of said second region.

8. The RF filter according to claim 1 wherein substrate properties of at least one of said first and second regions is controlled by the addition of meta-materials to respective ones of said first and second dielectric substrate materials.

9. The RF filter according to claim 1 wherein said substrate properties are controlled by the creation of voids in at least one of said first and second dielectric substrate materials.

10. The RF filter according to claim 1 further comprising a supplemental layer of said substrate disposed beneath said filter sections.

11. An RF filter comprising:

a substrate comprising at least one substrate layer having a first dielectric substrate material in a first region and at least a second dielectric substrate material in a second region, said second dielectric substrate material having substrate properties different than said first dielectric substrate material;

a first filter section coupled to said first region and at least a second filter section coupled to said second region;

wherein said first and second filter sections are comprised of transmission line sections selected from the group consisting of microstrip, buried microstrip, and stripline, said transmission line sections having impedances influenced by said regions of said substrate to which said filter sections are coupled.

12. An RF titter comprising:

a circuit board substrate comprising at least one substrate having a first dielectric substrate material in a first region and at least a second dielectric substrate material in a second region, said second dielectric substrate material having substrate properties different than said first dielectric substrate material;

a first filter section disposed on said substrate and coupled to said first region and a second filter section disposed on said substrate and coupled to said second region;

said first and second filter sections each comprising a transmission line section selected from the group consisting of microstrip, buried microstrip, and stripline, said transmission line sections having respective impedances influenced by said regions of said substrate to which said filter sections are coupled.

13. The RF filter according to claim 12 wherein a permeability and a permittivity of said first region are different as compared to a permeability and a permittivity of said second region.

14. The RF filter according to claim 12 wherein substrate properties of at least one of said first and second regions is controlled by the addition of meta-materials to respective ones of said first and second dielectric substrate materials.

* * * * *

UNITED STATES PATENT AND TRADEMARK OFFICE

CERTIFICATE OF CORRECTION

PATENT NO. : 6,781,486 B2
DATED : August 24, 2004
INVENTOR(S) : Killen et al.

It is certified that error appears in the above-identified patent and that said Letters Patent is hereby corrected as shown below:

Column 10,
Line 42, delete "titter" and replace with -- filter --

Signed and Sealed this

Twenty-eighth Day of June, 2005

JON W. DUDAS
*Director of the United States Patent and Trademark Office*